US006004005A

United States Patent [19]

Demshki, Jr.

[11] Patent Number: 6,004,005

[45] Date of Patent: Dec. 21, 1999

[54] TRACK LIGHTING FIXTURE HAVING ONE OR MORE DECORATIVE LAMP HOUSINGS WITH COMMON OUTER HOUSING AND INTERCHANGEABLE DECORATIVE INSERTS

[75] Inventor: Robert J. Demshki, Jr., Cherryville, N.C.

[73] Assignee: Hubbell, Inc., Orange, Conn.

[21] Appl. No.: 09/032,105

[22] Filed: Feb. 27, 1998

[51] Int. Cl.[6] ..... F21V 1/00; H01R 25/00

[52] U.S. Cl. ..... 362/238; 362/239; 362/233; 362/250; 362/226; 362/33; 362/147; 362/322; 362/371; 362/372; 362/404; 362/419; 362/270; 362/275; 362/287; 439/118; 439/121

[58] Field of Search ..... 362/238, 239, 362/233, 250, 226, 33, 147, 322, 371, 372, 404, 419, 270, 275, 287; 439/118, 121

[56] References Cited

U.S. PATENT DOCUMENTS 4,118,760 10/1978 Cohon ..... 362/239
4,833,579 5/1989 Skegin ..... 362/362
5,072,216 12/1991 Grange ..... 340/825.52

*Primary Examiner*—Sandra O'Shea
*Assistant Examiner*—Ronald E. Delgizzi
*Attorney, Agent, or Firm*—Scully, Scott Murphy & Presser

[57] ABSTRACT

A track lighting fixture in which decorative lamp housings are adjustably positionable along a fixture track, and which provides for several angular adjustments of each decorative lamp housing. Each decorative lamp housing comprises a common outer housing in which different interchangeable decorative inserts can be interchangeably inserted. In first and second embodiments, each track lamp fixture has a power supply housing for an enclosed power transformer and power supply which is attached to the fixture track. A support element of the power supply housing is rotationally mounted relative to the power supply housing and supports a decorative lamp housing thereon, such that the support element and decorative lamp housing can be rotated to different angular positions. In the first embodiment, the power supply housing comprises a cylindrical shaped housing, and in the second embodiment, the power supply housing comprises a rectangular shaped housing. In a third embodiment, each track lamp fixture does not include a power supply housing, and instead is powered directly from the fixture track.

11 Claims, 3 Drawing Sheets

TRACK LIGHTING FIXTURE HAVING ONE OR MORE DECORATIVE LAMP HOUSINGS WITH COMMON OUTER HOUSING AND INTERCHANGEABLE DECORATIVE INSERTS

BACKGROUND OF THE INVENTION

1. Field of the Invention

The present invention relates generally to a track lighting fixture, and more particularly pertains to a track lighting fixture which provides for several angular adjustments of a decorative lamp housing supported thereon.

SUMMARY OF THE INVENTION

Accordingly, it is a primary object of the present invention to provide a new style of track lighting fixture which provides for several angular adjustments of a decorative lamp housing supported thereon.

A further object of the subject invention is the provision of a track lighting fixture which supports thereon one or more decorative lamp housings wherein each decorative lamp housing comprises a common outer housing in which different interchangeable decorative inserts can be interchangeably inserted.

In accordance with the teachings herein, the present invention provides a track lighting fixture having a fixture track along which one or more track lamp fixtures can be adjustable positioned and receive electrical power from the fixture track. At least one track lamp fixture is adjustably positioned along the fixture track and has a power supply housing which is attached to the fixture track. A support element of the power supply housing is rotationally mounted relative to the power supply housing and supports a decorative lamp housing thereon, such that the support element and decorative lamp housing can be rotated to different angular positions relative to the power supply housing.

In greater detail, the power supply housing can comprise a cylindrical shaped housing, and the rotationally mounted support element comprises a circular cup shaped support element rotationally mounted to the bottom of the cylindrical housing. In alternative embodiments, the power supply housing can comprise a rectangular shaped housing, and the rotationally mounted support element comprises a circular shaped support element rotationally mounted to the bottom of the rectangular housing.

Moreover, the support element supports the decorative lamp housing thereon by a swivel attachment which includes a horizontally positioned pivot shaft, about which the decorative lamp housing rotates relative to the support element. The cylindrical or rectangular shaped housing provides an enclosure for a power transformer and regulated power supply for the at least one track fixture in a first set of embodiments. In a second set of embodiments each track lamp fixture is powered directly from the fixture track without an enclosed power transformer and power supply.

Each decorative lamp housing comprises a common outer housing in which different interchangeable decorative inserts can be interchangeably inserted. The interchangeable decorative inserts can be transparent, translucent or opaque, and can be a stepped glass insert, a metal mesh insert, a perforated metal insert, an opaque insert, or no insert, leaving the lamp bulb exposed.

BRIEF DESCRIPTION OF THE DRAWINGS

The foregoing objects and advantages of the present invention for a track lighting fixture may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
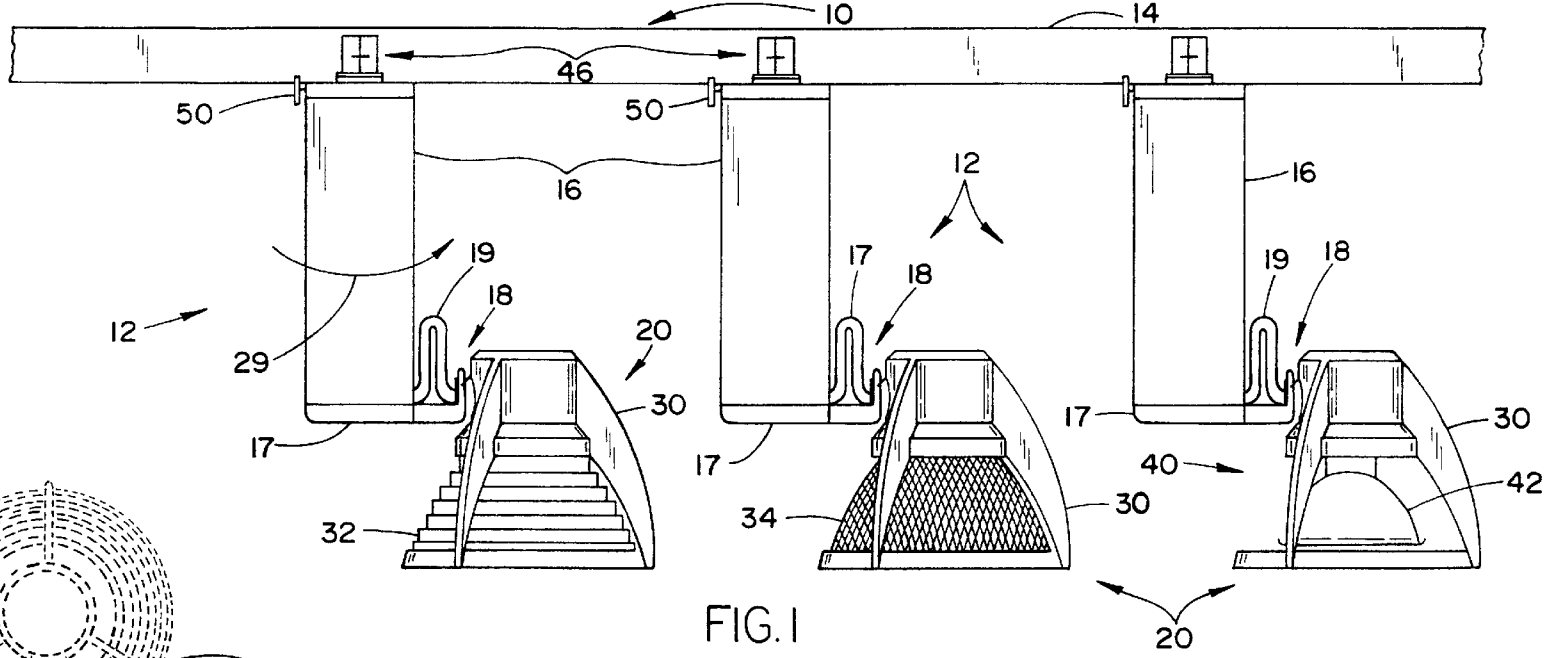
FIG. 1 illustrates a first embodiment of a new style of track lighting fixture pursuant to the present invention having a plurality of individual track lamp fixtures variably positioned along the length of a fixture track.

Referring to the drawings in detail, FIG. 1 illustrates a first embodiment of a new style of track lighting fixture 10 having a plurality of individual track lamp fixtures 12 variably positioned along the length of a fixture track 14. Each individual track lamp fixture 12 has a vertically oriented cylindrical housing 16 which is secured to the fixture track 14. The fixture track 14 is a normal type of track for a track lighting fixture, and serves to allow one or more track lamp fixtures 12 to be selectively and variably positioned along the length thereof while providing electrical contacts to supply electrical power to the track lamp fixtures 12.

Figure 1A:
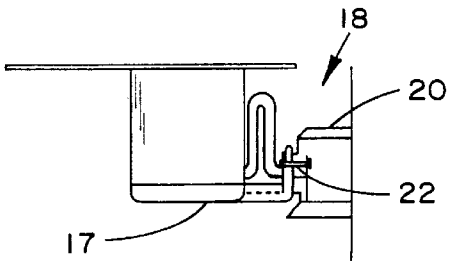
FIG. 1A is an enlarged view of a swivel attachment having a horizontal pivot shaft which allows a decorative lamp housing to rotate relative to a cylindrical housing.
Figure 1B:
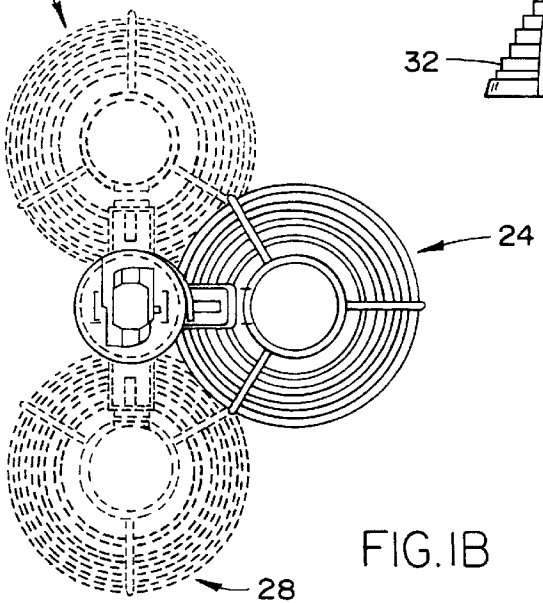
FIG. 1B illustrates three different rotational positions of the decorative lamp housing.

A support element in the form of a bottom cap 17 is rotatably mounted to the bottom of each cylindrical housing 16 by a circular-track, swivel mounting which is capable of rotating 180° about the vertical housing 16. The bottom cap 17 forms a support element which supports a decorative lamp housing 20 thereon for rotation therewith. FIG. 1B illustrates three different rotational positions 24, 26 and 28 of a decorative lamp housing 20 when the bottom cap 17 is rotated relative to the cylindrical housing 16, as indicated by rotational arrow 29.

Each decorative lamp housing 20 is mounted onto the bottom cap 17 by a second swivel attachment 18. FIG. 1A is an enlarged view of the swivel attachment 18, and illustrates a horizontal pivot shaft 22 which allows the decorative lamp housing 20 to rotate relative to the bottom cap 17 of the vertical cylindrical housing 12 about the horizontal pivot shaft 22. The decorative lamp housing 20 is capable of rotating slightly less than 360° about horizontal pivot shaft 22, to provide a further angular adjustment of the decorative lamp housing 20.

The arrangement is such that the bottom cap 17 can be adjustably rotatably positioned relative to the cylindrical housing 16, and the decorative lamp housing 20 can also be adjustably rotatably positioned relative to the bottom cap 17.

Figure 8:
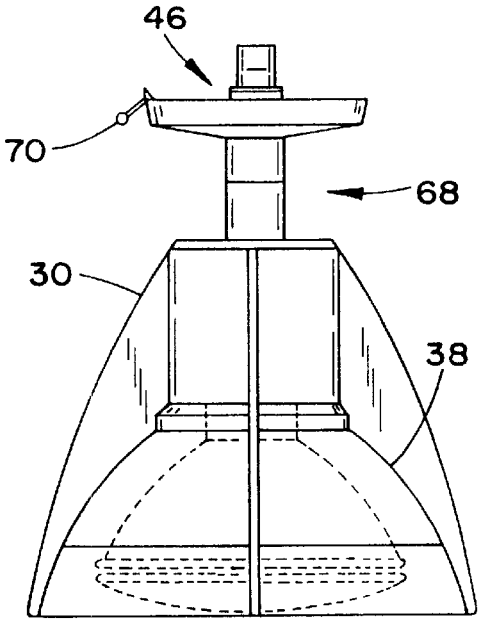

The three decorative lamp housings 20 shown in FIG. 1 each have a common outer housing 30 with different interchangeable decorative inserts. The decorative insert can be any one of several decorative options, such as a stepped glass shade 32 as illustrated on the left side of FIG. 1, a metal mesh shade 34 as illustrated in the middle of FIG. 1, a perforated metal shade 36 as illustrated on the left side of FIG. 2, an opaque shade 38 as illustrated in FIG. 8, or with no shade to directly expose the lamp bulb 42 as illustrated at 40 on the right side of FIG. 1. The different interchangeable decorative inserts can be transparent or translucent or opaque, colored or noncolored, glass as at 32. The decorative lamp fixture 34 is metal mesh and is substantially opaque. The decorative lamp fixture 40 is shown without an interchangeable insert, such that the lamp bulb 42, such as a model MR16 lamp, is directly visible. Any combination of decorative inserts and lamp bulbs can be interchanged.

Figure 2:
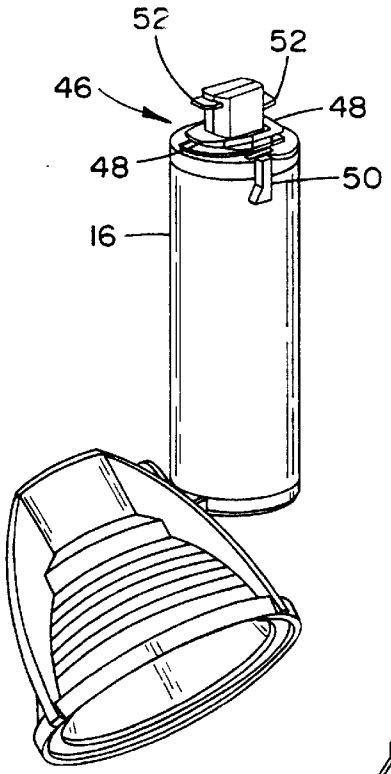
FIG. 2 is a front perspective view of the leftmost track lamp fixture of FIG. 1 which is adjusted and positioned a particular angular position, and also illustrates a lamp electrical contact and track retainer assembly which projects from the top of the cylindrical housing.

FIG. 2 is a front perspective view of the leftmost track lamp fixture 12 of FIG. 1 which is adjusted and positioned at one particular angular position. FIG. 2 also illustrates a lamp electrical contact and track retainer assembly 46 which projects from the top of the cylindrical housing 16. During installation, the projecting assembly 46 is inserted into the fixture track 14 and rotated 90°, which causes a track retainer 48 to engage opposing sides of the track 14 and a locking element 50 to lock the track lamp fixture 12 in place therein, with two hot and two common electrical contacts 52 of the track lamp fixture contacting corresponding electrical contacts in the fixture track 14.

During initial installation of the individual track lamp fixtures 12 into the fixture track 14, each track lamp fixture 12 is initially placed at an appropriate position along the fixture track 14, to provide for a first, linear adjustment of the position of the track lamp fixture 12.

Each track lamp fixture 12 can be inserted into and locked into place in the fixture track 14 in one of two angular positions which are 180° apart, which provides a second, angular adjustment of the position of the track lamp fixture 12. One advantage of the cylindrical housing 16 is that it presents a uniform appearance to an observer in either of the 180° displaced positions.

The bottom cap 17 of the track lamp fixture 12 is capable of being rotated approximately 180° relative to the cylindrical housing 16. The bottom cap 17, an electrical conductor 19 and the decorative lamp housing 20 rotate in common relative to the cylindrical housing 16 to provide a third, angular adjustment of the position of the lamp assembly.

The pivotal rotation of the decorative lamp housing 18 relative to the bottom cap 17 about the horizontal pivot shaft 22 provides a fourth, angular adjustment of the position of the decorative lamp housing.

The cylindrical housing 16 provides an enclosure for a power transformer and regulated power supply for the lamp, and the cylindrical enclosure 16 also advantageously presents a common appearance at all possible angular positions of the cylindrical housing. Most enclosures in the prior art have rectangular or square shapes, not cylindrical shapes.

Figure 4:
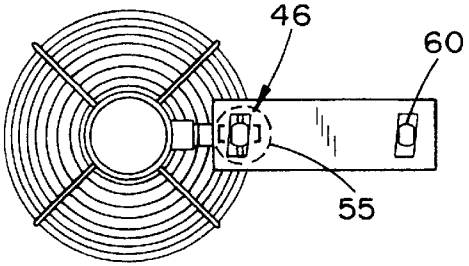
FIG. 4 is a top plan view of only the central lamp fixture of FIG. 3.
Figure 3:
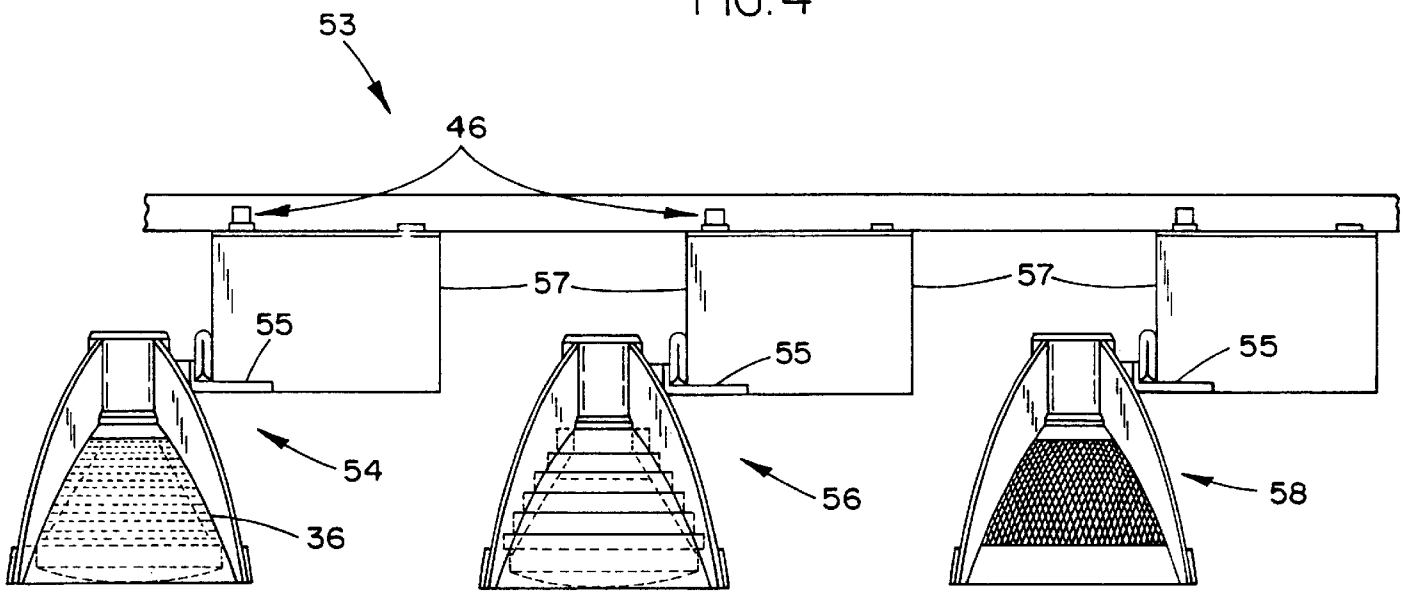
FIG. 3 is a front elevational view of a further embodiment of a track lighting fixture pursuant to the present invention, shown with three different types of decorative lamp housings.

The track lamp fixtures 12 of FIG. 1 have a cylindrical enclosure for the lamp power supply, while the track lamp fixtures of FIGS. 3 and 4 have a rectangular box enclosure or module for the lamp power supply, which provides a larger volume for a larger power supply transformer and other electrical components of the power supply.

FIG. 3 is a front elevational view of a further embodiment of a track lighting fixture 53 pursuant to the present invention, shown with three different types of decorative lamp housings at 54, 56 and 58. Each of the embodiments of track lamp fixtures shown in FIG. 3 includes a circular support element 55 which is rotationally mounted in a circular support track on the bottom of the rectangular power supply enclosure 57 to provide the equivalent function of rotationally supported bottom cap 17 in FIG. 1.

FIG. 4 is a top plan view of only the central track lamp fixture of FIG. 2, and illustrates a projecting electrical contact and track retainer assembly 46 similar to that illustrated in FIG. 2, and a locking element 60 which functions to lock the track lamp fixture in place in the fixture track 14.

FIGS. 5, 6, 7 and 8 are respectively front elevational views of different embodiments 62, 64, 66 and 68 of track lamp fixtures pursuant to the present invention. The track lamp fixtures of FIGS. 5–8 operate directly from 120 VAC power supplied by the fixture track 14. The track lamp fixtures of FIGS. 5–8 plug directly into the fixture track 14, and do not comprise a transformer and power supply housing similar to the embodiments of FIGS. 1–4. Each track lamp fixture comprises a lamp electrical contact and track retainer assembly 46 similar to that of FIG. 2. After being properly positioned along and in the fixture track 14, the track lamp fixtures of FIGS. 5–8 are rotated 90° to engage the fixture track 14 and lock relative thereto by a locking element 70, and also to engage complementary electrical contacts of the fixture track 14.

Figure 5:
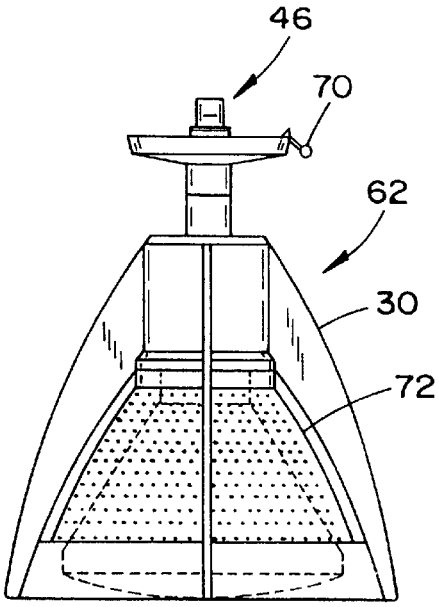
FIG. 5, 6, 7 and 8 are front elevational views of different embodiments of track lamp fixtures pursuant to the present invention, wherein each fixture is powered directly from the fixture track without a power transformer.
Figure 6:
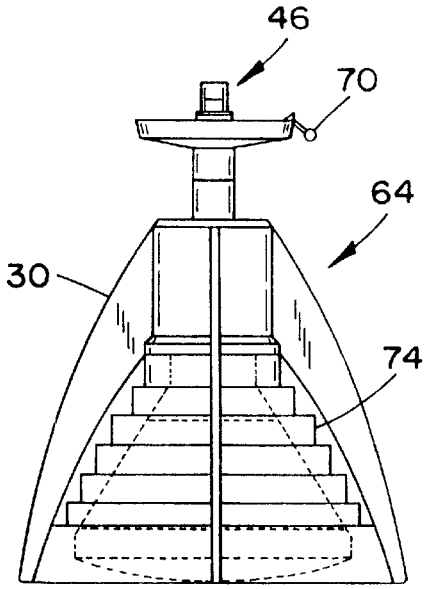
Figure 7:
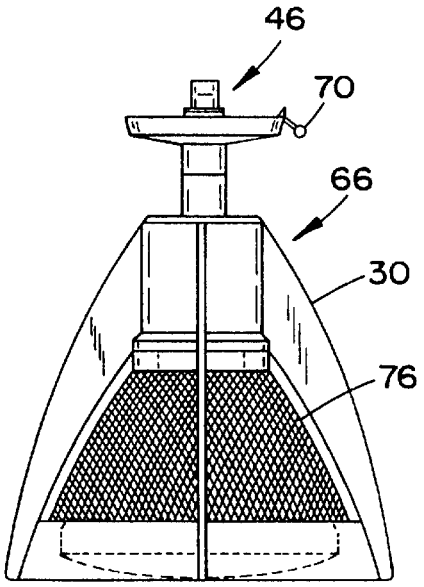

Similar to the previously described embodiments, the embodiments of FIGS. 5–8 have a common outer housing 30, shown with different interchangeable decorative inserts, a perforated insert 72 in FIG. 5, a stepped glass insert 74 in FIG. 6, a metal mesh insert 76 in FIG. 7, and an opaque insert 38 in FIG. 8.

While several embodiments and variations of the present invention for a tracking lighting fixture are described in detail herein, it should be apparent that the disclosure and teachings of the present invention will suggest many alternative designs to those skilled in the art.

What is claimed is:

1. A track lighting fixture comprising:

a. a fixture track along which one or more track lamp fixtures can be adjustably positioned and which provides electrical power to the one or more track lamp fixtures positioned along the fixture track;

b. at least one track lamp fixture adjustably positioned along the fixture track and having a power supply housing which is adiustably positioned along and attached to the fixture track, wherein the power supply housing comprises a cylindrical shaded housing which is supported to extend below the fixture track, and a support element of the power supply housing is rotationally mounted relative to the power supply housing and supports a decorative lamp housing thereon, wherein the rotationally mounted support element comprises a circular cup-shaped support element rotationally mounted to the bottom of the cylindrical housing, such that the support element and decorative lamp housing can be rotated to different angular positions relative to the power supply housing.

2. A track lighting fixture as claimed in claim 1, wherein the support element supports the decorative lamp housing thereon by a swivel attachment which includes a pivot shaft, about which the decorative lamp housing rotates relative to the support element.

3. A track lighting fixture as claimed in claim 2, wherein the swivel attachment pivot shaft is horizontally positioned.

4. A track lighting fixture as claimed in claim 1, wherein the cylindrical housing provides an enclosure for a power transformer and regulated power supply for the at least one track fixture.

5. A track lighting fixture as claimed in claim 1, wherein each decorative lamp housing comprises a common outer housing in which different interchangeable decorative inserts can be interchangeably inserted.

6. A track lighting fixture as claimed in claim 5, wherein the interchangeable decorative inserts can be transparent, translucent or opaque.

7. A track lighting fixture as claimed in claim 5, wherein the interchangeable decorative inserts can be a stepped glass insert, a metal mesh insert, a perforated metal insert, an opaque insert, or no insert.

8. A track lighting fixture as claimed in claim 1, wherein the power supply housing comprises a rectangular shaped housing, and the rotationally mounted support element comprises a circular shaped support element rotationally mounted to the bottom of the rectangular housing.

9. A track lighting fixture as claimed in claim 8, wherein the support element supports the decorative lamp housing thereon by a swivel attachment which includes a pivot shaft, about which the decorative lamp housing rotates relative to the support element.

10. A track lighting fixture as claimed in claim 9, wherein the swivel attachment pivot shaft is horizontally positioned.

11. A track lighting fixture as claimed in claim 8, wherein the cylindrical housing provides an enclosure for a power transformer and regulated power supply for the at least one track fixture.

* * * * *

UNITED STATES PATENT AND TRADEMARK OFFICE

CERTIFICATE OF CORRECTION

PATENT NO. : 6,004,005
DATED : December 21, 1999
INVENTOR(S) : R. J. Demshki, Jr.

It is certified that error appears in the above-identified patent and that said Letters Patent is hereby corrected as shown below:

Column 2,
Line 18, "positioned a" should read -- positioned at one --

Column 4,
Line 50, "shaded" should read -- shaped --

Signed and Sealed this

Twenty-first Day of May, 2002

*Attest:*

*Attesting Officer*

JAMES E. ROGAN
*Director of the United States Patent and Trademark Office*